US010840599B2

(12) United States Patent
Foo

(10) Patent No.: US 10,840,599 B2
(45) Date of Patent: Nov. 17, 2020

(54) DIFFERENTIAL-MODE APERTURE-COUPLED PATCH ANTENNA

(71) Applicant: Senglee Foo, Ottawa (CA)

(72) Inventor: Senglee Foo, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 169 days.

(21) Appl. No.: 16/039,853

(22) Filed: Jul. 19, 2018

(65) Prior Publication Data

US 2020/0028267 A1 Jan. 23, 2020

(51) Int. Cl.
*H01Q 9/04* (2006.01)
*H01Q 1/22* (2006.01)

(52) U.S. Cl.
CPC ..... *H01Q 9/0442* (2013.01); *H01Q 1/2283* (2013.01); *H01Q 9/045* (2013.01)

(58) Field of Classification Search
CPC .... H01Q 9/0442; H01Q 1/2283; H01Q 9/045; H01Q 9/0457; H01Q 1/243
See application file for complete search history.

(56) References Cited

U.S. PATENT DOCUMENTS 5,241,321 A * 8/1993 Tsao ..... H01Q 9/0442 343/700 MS
6,054,953 A * 4/2000 Lindmark ..... H01Q 1/38 343/700 MS
6,288,679 B1 * 9/2001 Fischer ..... H01Q 9/0457 343/700 MS
7,626,549 B2 * 12/2009 Channabasappa ... H01Q 9/0457 343/700 MS
2014/0184455 A1 7/2014 Lea et al.
2016/0240925 A1 8/2016 Xue et al.
2017/0271767 A1 9/2017 Nair et al.

FOREIGN PATENT DOCUMENTS

CN 105789875 A 7/2016

* cited by examiner

*Primary Examiner* — Hai V Tran
*Assistant Examiner* — Michael M Bouizza

(57) ABSTRACT

An aperture-coupled patch antenna is described. The antenna includes at least one radiating patch. A first aperture couples a reception signal from the patch to first and second receive ports. A second orthogonal aperture couples a transmission signal from a transmit port to the patch. The transmit feed circuit is a single-ended feed circuit. The receive feed circuit is a differential-mode feed circuit. The receive feed circuit defines a difference port, where the electrical path lengths from the first receive port to the difference port and from the second receive port to the difference port differ by an odd integer multiple of half a signal wavelength. The receive feed circuit also defines a sum port, where the electrical path lengths from the first receive port to the sum port and from the second receive port to the sum port are equal in path length.

18 Claims, 10 Drawing Sheets

DIFFERENTIAL-MODE APERTURE-COUPLED PATCH ANTENNA

FIELD

The present disclosure relates to antennas, including aperture-coupled patch antennas useful for communications in a wireless network.

BACKGROUND

An aperture-coupled patch antenna is a type of patch antenna (also referred to as microstrip antenna) in which the feed is electromagnetically coupled to the radiation patch via an aperture (e.g., a slot) in the substrate. By stacking radiation patches, an aperture-coupled stacked patch antenna can achieve broader bandwidths. A broadband dual-polarized aperture-coupled stacked patch antenna has been a popular choice of radiating element in wireless communication devices, such as in design of base station antenna arrays. This type of radiating element has been found to provide features such as being broadband, being dual-polarized, being low cost, providing ease of manufacturing and/or having a relatively low profile. Broadband dual-polarized aperture-coupled stacked patch antennas have also been commonly used for receive-diversity and multiple-input multiple-output (MIMO) transmission.

In conventional designs of broadband dual-polarized aperture-coupled stacked patch antennas, there is a typical polarization isolation of about 30 dB (or less) between the two orthogonal ports when used as an isolated radiation element. When such conventional antennas are used in a closely packed array configuration, there is typically an isolation between about 20 dB to 30 dB (or less). Unfortunately, this isolation performance has been found to be inadequate for a full-duplex base station antenna array configuration.

It is desirable to provide an antenna design that provides improved isolation between the two orthogonal ports of a dual-polarized aperture-coupled patch antenna.

SUMMARY

In various examples, the present disclosure describes an aperture-coupled patch antenna with a single-ended feed configuration for the transmit port, and a differential-mode feed configuration for the receive port. Using a differential-mode feed configuration for the receive port enables rejection of potential interference signals from the transmit port, during full-duplex communications. Examples of the disclosed dual-polarized aperture-coupled patch antenna may achieve an isolation improvement of 10 dB to 20 dB compared to conventional dual-polarized aperture-coupled stacked patch antenna designs.

In some aspects, the present disclosure describes an aperture-coupled patch antenna. The antenna includes at least one radiating patch and a substrate supporting the at least one radiating patch. The substrate includes a first slot-shaped aperture for electromagnetic coupling of a reception signal from the at least one radiating patch to first and second receive ports; and a second slot-shaped aperture, orthogonal to the first aperture, for electromagnetic coupling of a transmission signal from a transmit port to the at least one radiating patch. The antenna also includes a transmit feed circuit provided on the substrate for communicating the transmission signal to the transmit port, the first feed circuit being a single-ended feed circuit. The antenna also includes a receive feed circuit provided on the substrate for communicating the reception signal from the receive ports, the receive feed circuit being a differential-mode feed circuit. The receive feed circuit defines a difference port between the first and second receive ports. A first electrical path length travelled by a signal from the first receive port to the difference port and a second electrical path length travelled by a signal from the second receive port to the difference port differ by an odd integer multiple of half a signal wavelength. The receive feed circuit also defines a sum port between the first and second receive ports. A third electrical path length travelled by a signal from the first receive port to the sum port and a fourth electrical path length travelled by a signal from the second receive port to the sum port are equal in path length.

In any of the preceding embodiments/aspects, the receive feed circuit may include a difference path portion provided on a first side of the substrate and a sum path portion provided on an opposing second side of the substrate. The difference path portion may include the first and second electrical path lengths, and the sum path portion may include the third and fourth electrical path lengths.

In any of the preceding embodiments/aspects, the substrate may be a double-sided printed circuit board (PCB), and the difference path portion and the sum path portion may be printed on respective sides of the PCB.

In any of the preceding embodiments/aspects, the substrate may include a first printed circuit board (PCB) on which the difference path portion may be provided, and a second PCB on which the sum path portion may be provided.

In any of the preceding embodiments/aspects, the first and second receive ports may be located at opposite ends of the second aperture, to cause the first receive port to receive a signal that is 180° offset from that received by the second receive port.

In any of the preceding embodiments/aspects, the first electrical path may have a path length of ¾ of the signal wavelength, and the second electrical path may have a path length of ¼ of the signal wavelength.

In any of the preceding embodiments/aspects, the third and fourth electrical paths each may have a path length of ¾ of the signal wavelength.

In any of the preceding embodiments/aspects, the substrate may include a ground plane of the antenna.

In any of the preceding embodiments/aspects, the first aperture and the second aperture may have different slot widths.

In any of the preceding embodiments/aspects, the first aperture and the second aperture may cross each other at respective midpoints.

In any of the preceding embodiments/aspects, the receive feed circuit may include a 180° hybrid coupler.

In any of the preceding embodiments/aspects, the antenna may include two radiating patches. The first aperture may electromagnetically couple the reception signal from the two radiating patches to the receive ports. The second aperture may electromagnetically couple the transmission signal from the transmit port to the two radiating patches.

In some aspects, the present disclosure describes a differential-mode feed circuit for an aperture-coupled patch antenna. The feed circuit includes a first port and a second port. The first and second ports are configured to be located at opposite ends of an aperture of the aperture-coupled patch antenna, to cause the first port to receive a signal that is 180° offset from that received by the second port. The feed circuit also includes a difference port between the first and second ports. A first electrical path length travelled by a signal from the first port to the difference port and a second electrical path length travelled by a signal from the second port to the difference port differ by an odd integer multiple of half a signal wavelength. The feed circuit also includes a sum port between the first and second ports. A third electrical path length travelled by a signal from the first port to the sum port and a fourth electrical path length travelled by a signal from the second port to the sum port are equal in path length.

In any of the preceding embodiments/aspects, the first electrical path may have a path length of ¾ of the signal wavelength, and the second electrical path may have a path length of ¼ of the signal wavelength.

In any of the preceding embodiments/aspects, the third and fourth electrical paths each may have a path length of ¾ of the signal wavelength.

In any of the preceding embodiments/aspects, the feed circuit may include a 180° hybrid coupler.

In some aspects, the present disclosure describes a wireless communication device. The device includes a wireless communication interface for processing transmission and reception signals, and an aperture-coupled patch antenna for communicating the transmission and reception signals. The antenna includes at least one radiating patch and a substrate supporting the first and second radiating patches. The substrate includes: a first slot-shaped aperture for electromagnetic coupling of the reception signal from the at least one radiating patch to first and second receive ports; and a second slot-shaped aperture, orthogonal to the first aperture, for electromagnetic coupling of the transmission signal from a transmit port to the at least one radiating patch. The antenna also includes a transmit feed circuit provided on the substrate for communicating the transmission signal to the transmit port, the first feed circuit being a single-ended feed circuit. The antenna also includes a receive feed circuit provided on the substrate for communicating the reception signal from the receive ports, the receive feed circuit being a differential-mode feed circuit. The receive feed circuit defines a difference port between the first and second receive ports. A first electrical path length travelled by a signal from the first receive port to the difference port and a second electrical path length travelled by a signal from the second receive port to the difference port differ by an odd integer multiple of half a signal wavelength. The receive feed circuit also defines a sum port between the first and second receive ports. A third electrical path length travelled by a signal from the first receive port to the sum port and a fourth electrical path length travelled by a signal from the second receive port to the sum port are equal in path length.

In any of the preceding embodiments/aspects, in the antenna, the first and second receive ports may be located at opposite ends of the second aperture, to cause the first receive port to receive a signal that is 180° offset from that received by the second receive port.

In any of the preceding embodiments/aspects, in the antenna, the first electrical path may have a path length of ¾ of the signal wavelength, and the second electrical path may have a path length of ¼ of the signal wavelength.

In any of the preceding embodiments/aspects, in the antenna, the third and fourth electrical paths each may have a path length of ¾ of the signal wavelength.

In any of the preceding embodiments/aspects, the wireless communication interface may be configured for full-duplex wireless communications.

In any of the preceding embodiments/aspects, the antenna may include two radiating patches. The first aperture may electromagnetically couple the reception signal from the two radiating patches to the receive ports. The second aperture may electromagnetically couple the transmission signal from the transmit port to the two radiating patches.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

In various examples, the present disclosure describes a dual-polarized aperture-coupled patch antenna that offers improved isolation between the two orthogonal ports. The isolation achieved may be about 10 dB or more (e.g., in the range of 10 dB to 20 dB) above the isolation achieved by conventional dual-polarized aperture-coupled stacked patch antennas. Thus, examples of the disclosed dual-polarized aperture-coupled patch antenna may achieve an isolation in the range of about 40 dB to about 50 dB or more between orthogonal transmit and receive ports. This improved isolation may enable the disclosed dual-polarized aperture-coupled patch antenna to be used in a full-duplex phased array.

Figure 1:
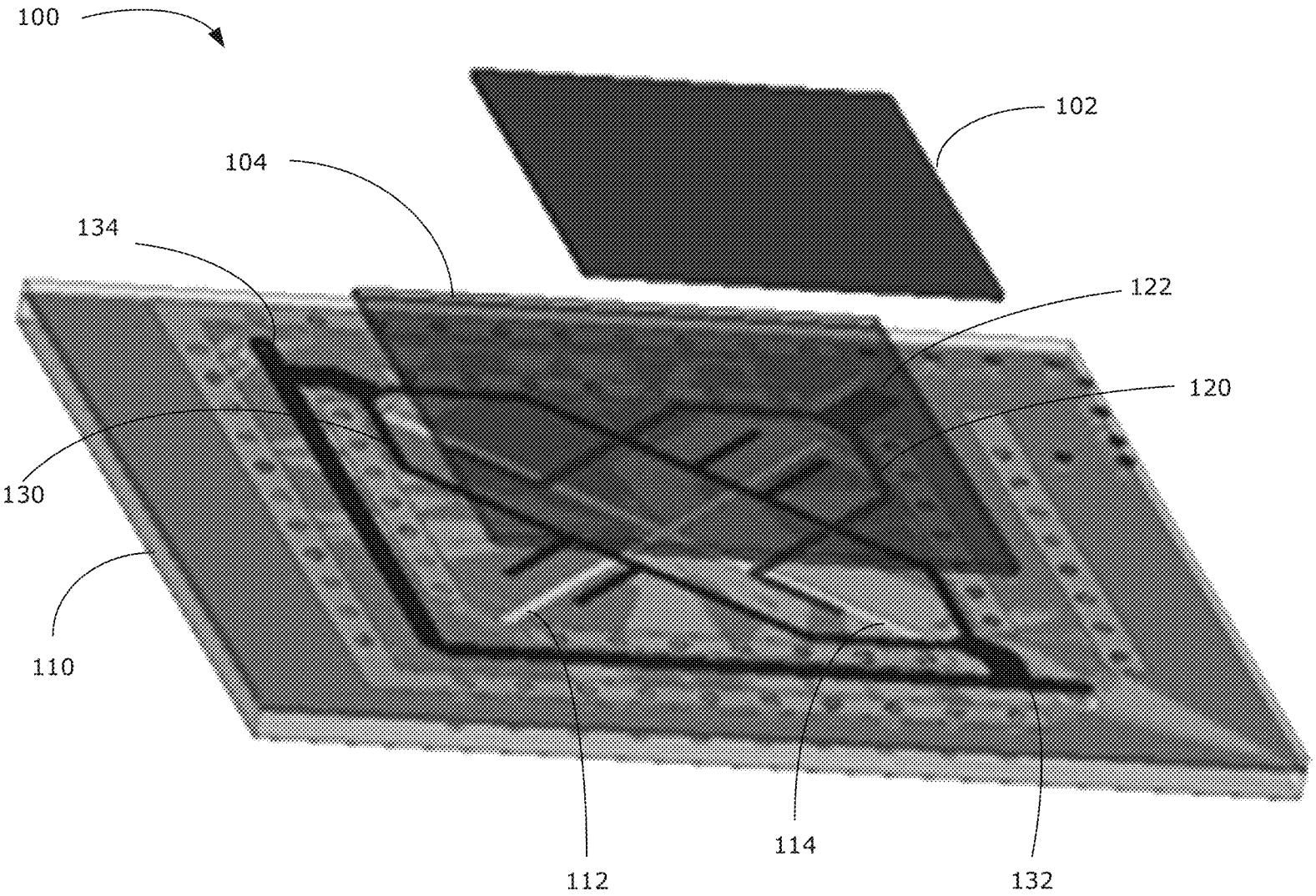
FIG. 1 is an isometric view of an example of the disclosed dual-polarized aperture-coupled patch antenna.
Figure 2:
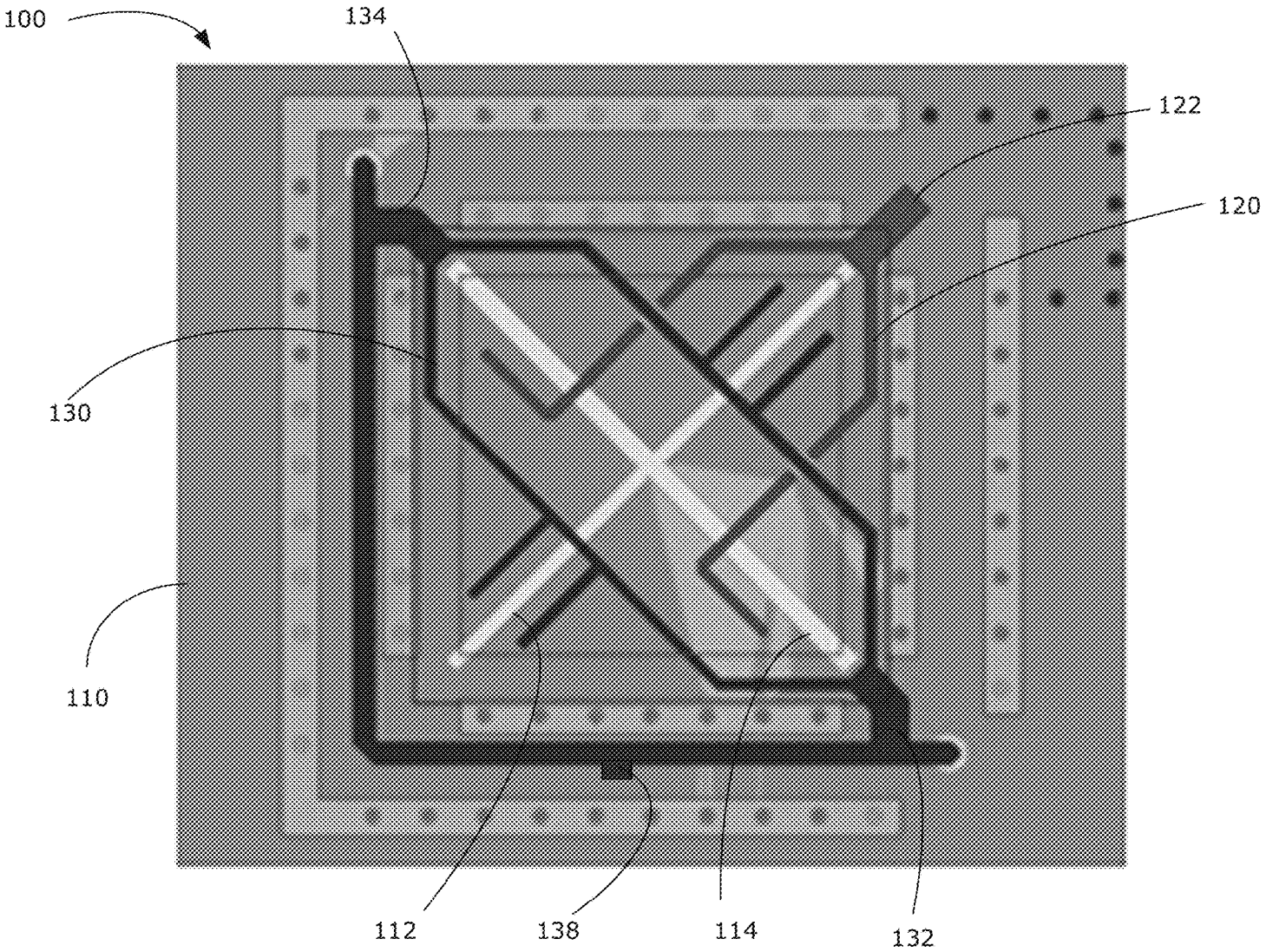
FIG. 2 is a planar view of a first side of a substrate for the example antenna of FIG. 1, showing transmit and receive feed circuits.
Figure 3:
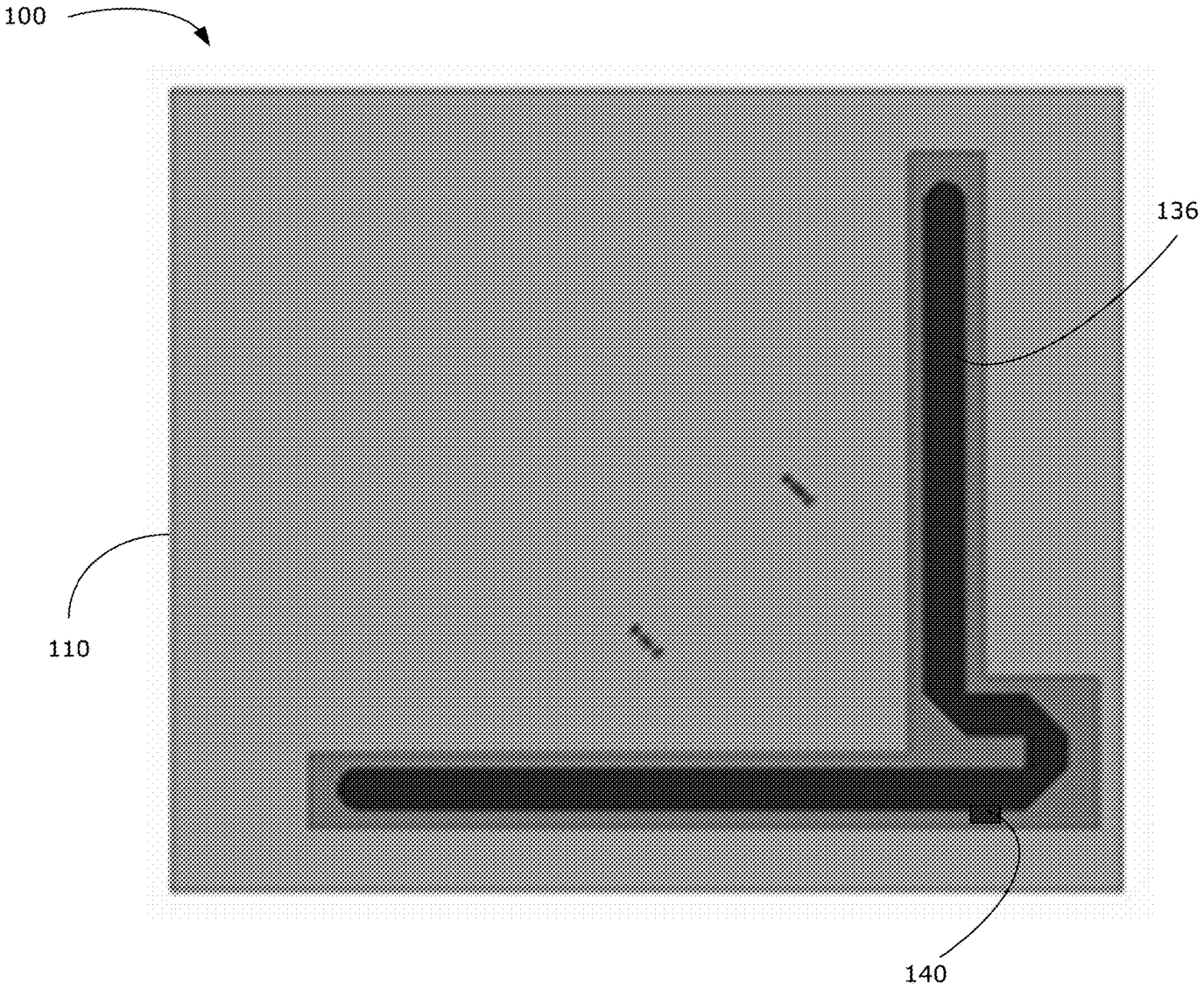
FIG. 3 is a planar view of a second side of the substrate, showing a sum path for the receive feed circuit.
Figure 4:
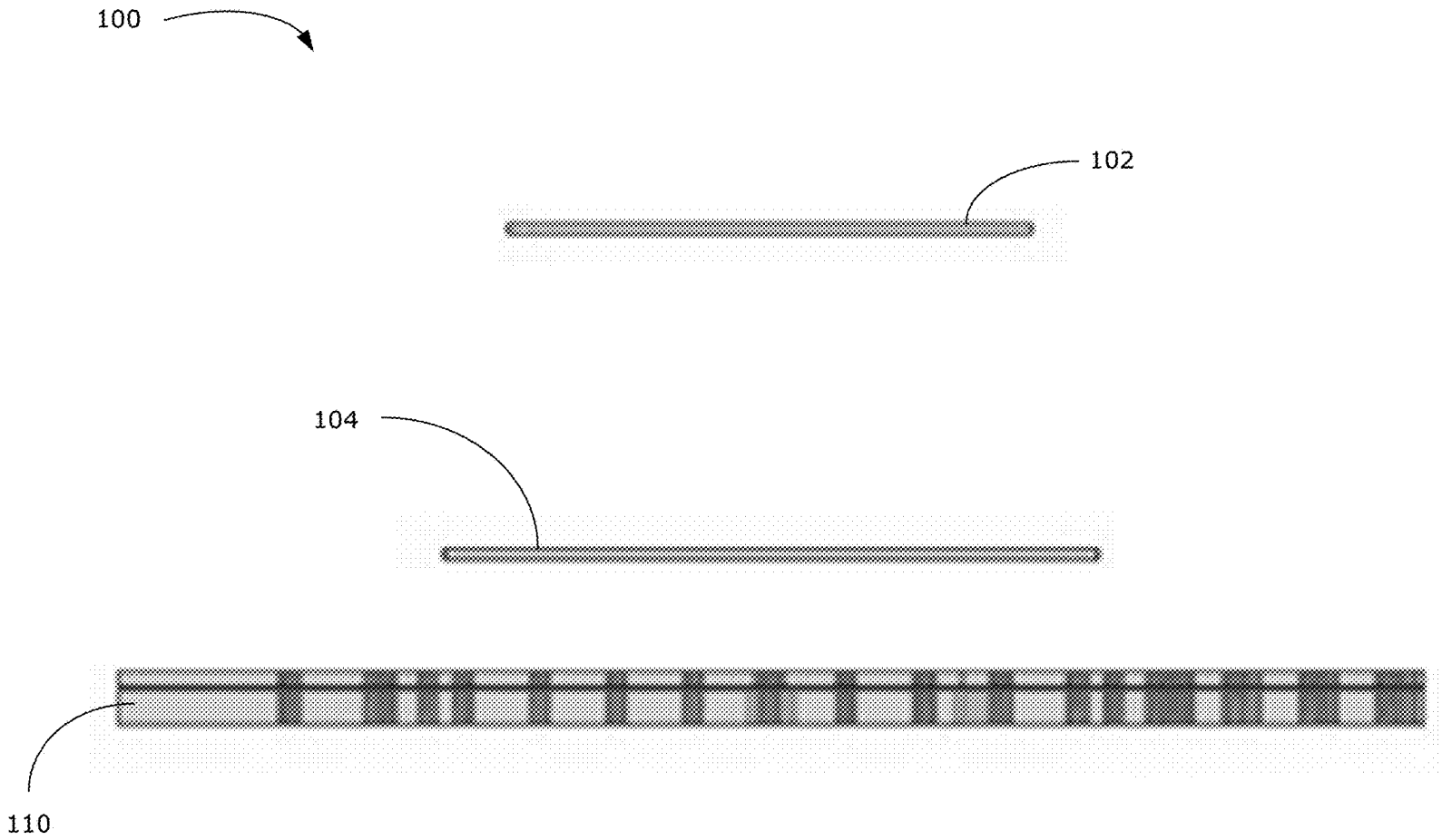
FIG. 4 is a side view of the example antenna of FIG. 1.

Reference is made FIGS. 1-4, showing an example of the disclosed dual-polarized aperture-coupled patch antenna 100 (also referred to herein as antenna 100, for brevity). FIG. 1 shows the example antenna 100 in an isometric view; FIG. 2 shows a planar view of one side (which may be referred to as the top side) of the example antenna 100; FIG. 3 shows a planar view of an opposite side (which may be referred to as the bottom side) of the example antenna 100; and FIG. 4 shows a side view of the example antenna 100. The antenna 100 may be used for full-duplex wireless communications, in which transmission signals and reception signals may be communicated using the same time-frequency resources (i.e., using the same frequency band at the same time). The antenna 100 may be an element of an antenna array, or may be used as an individual antenna. The antenna 100, whether used in an array or by itself, may be used for wireless communications (e.g., receiving and transmitting wireless signals) in a wireless communication device such as a base station, an access port or client device (e.g., a laptop device).

The antenna 100 includes a first radiating patch 102 and a second radiating patch 104, stacked over each other. The radiating patches 102, 104 may be sized to achieve the desired frequency bandwidth. Both radiating patches 102, 104 are supported by a substrate 110. The substrate 110 may be any suitable substrate, for example a printed circuit board (PCB) or a stack of PCBs. The substrate 110 may include multiple layers, for example including a layer that may serve as a ground plane for the antenna 100. The substrate 110 may be provided (e.g., printed) on one or both sides with conductive elements, as discussed further below. The example antenna 100 shown in FIGS. 1-4 is an aperture-coupled stacked patch antenna that includes two stacked radiating patches 102, 104, which may operate together to increase the overall bandwidth of the antenna 100. In other examples, there may be a single radiating patch (e.g., if a narrower frequency bandwidth is sufficient). Although the present disclosure makes reference to an example stacked patch antenna 100 having two radiating patches 102, 104, it should be understood that other examples of the disclosed antenna may not be a stacked patch antenna and may use a single radiating patch.

The substrate 110 includes a first aperture 112 and a second aperture 114, each of which may be slot-shaped and may also be referred to as first and second slots. The first and second apertures 112, 114 each has a longitudinal axis, and are configured to be orthogonal to each other, such that they cross each other. The first and second apertures 112, 114 may cross each other approximately at their respective midpoints. In some examples, the first and second apertures 112, 114 may have different slot widths. The first aperture 112 serves to electromagnetically couple a reception signal from the radiating patches 102, 104 to a first receive port 132 and a second receive port 134. The second aperture 114 serves to electromagnetically couple a transmission signal from a transmit port 122 to the radiating patches 102, 104.

A transmit feed circuit 120 is provided (e.g., printed) on the substrate 110. The transmit feed circuit 120 serves to communicate a transmission signal (e.g., a signal provided by a processor or other component of the wireless communication device in which the antenna 100 is implemented) to the transmit port 122. The transmission signal is coupled to the radiating patches 102, 104 via the second aperture 114, for transmission. A receive feed circuit 130 is provided (e.g., printed) on the substrate 110. The receive feed circuit 130 serves to communicate a reception signal from the receive ports 132, 134. The reception signal is received by the radiating patches 102, 104 and coupled to the receive ports 132, 134 via the first aperture 112.

Self-interference may be a concern for wireless communication. Self-interference refers to interference in a signal received at a wireless device, where that interference is caused by a transmission signal transmitted by the same wireless device. Self-interference can cause undesirable degradation of the reception signal, may be of particular concern for full-duplex communications where transmission and reception signals use the same time-frequency resources. A possible approach for mitigating self-interference is to use antenna designs that cancels or reduces the self-interference appearing at the receive port. Such techniques may be referred to as port isolation, or more simply isolation. Isolation may be particularly desirable where multiple antenna elements are used together in antenna array.

In examples disclosed herein, the antenna 100 serves to reduce or substantially eliminate self-interference (which may also be described as improving isolation) by using a differential-mode receive feed circuit 130 with a single-ended transmit feed circuit 120. Conventional aperture-coupled patch antennas typically uses a symmetrical feed circuit configuration, in which both the receive feed circuit and the transmit feed circuit have a single-ended configuration and have a single port. In the example antenna 100 disclosed herein, the transmit feed circuit 120 has a single-ended configuration (e.g., a single-fork configuration), however the receive feed circuit 130 has a differential-mode configuration (e.g., a double-fork configuration). The transmission signal is transmitted through the singled-ended transmit feed circuit 120 in one polarization, and the reception signal is received through the differential-mode receive feed circuit 130 in an orthogonal polarization, arriving in two opposite phases (e.g., 0° and 180°) at the two receive ports 132, 134 located at opposite ends of the second aperture 114.

The receive feed circuit 130 may include a difference path portion and a sum path portion. The difference path portion of the receive feed circuit 130 may be provided on one side of the substrate 110 (e.g., on the same side as the transmit feed circuit 120, as shown in FIG. 2) and the sum path portion 136 may be provided on the opposite side of the substrate 110 (as shown in FIG. 3). It should be noted that, because FIG. 3 shows the opposite side of the substrate 110, the sum path portion 136 shown in FIG. 3 is flipped vertically with respect to the difference path portion shown in FIG. 2. For example, the substrate 110 may be a double-sided PCB with the difference path and sum path portions of the receive feed circuit 130 printed on respective sides. In some examples, the difference path portion and the sum path portions may be printed on separate first and second PCBs, and the two PCBs may be coupled together to form the substrate 110.

Figure 5:
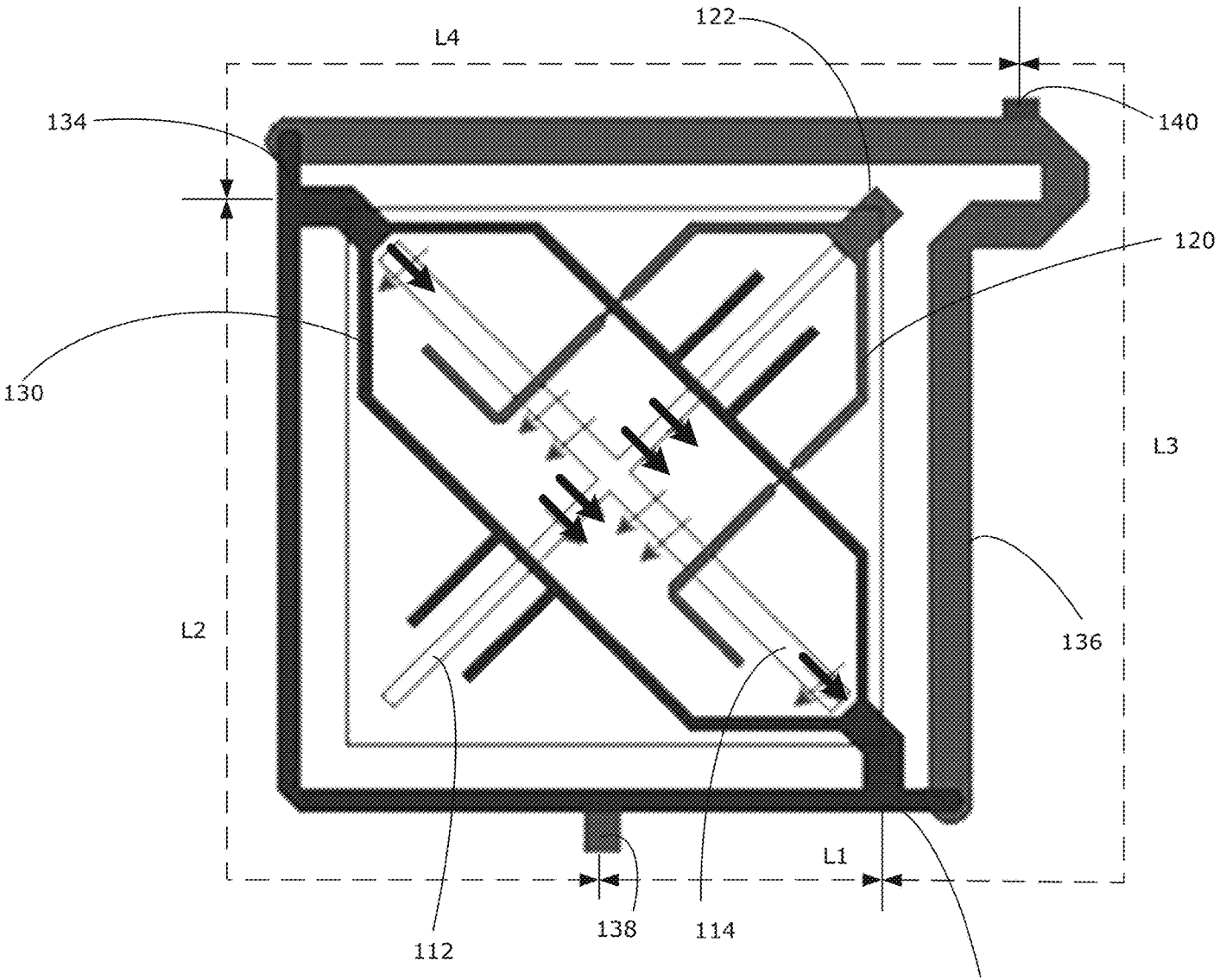
FIG. 5 is a composite view of the transmit and receive feed circuits for the example antenna of FIG. 1.
Figure 6:
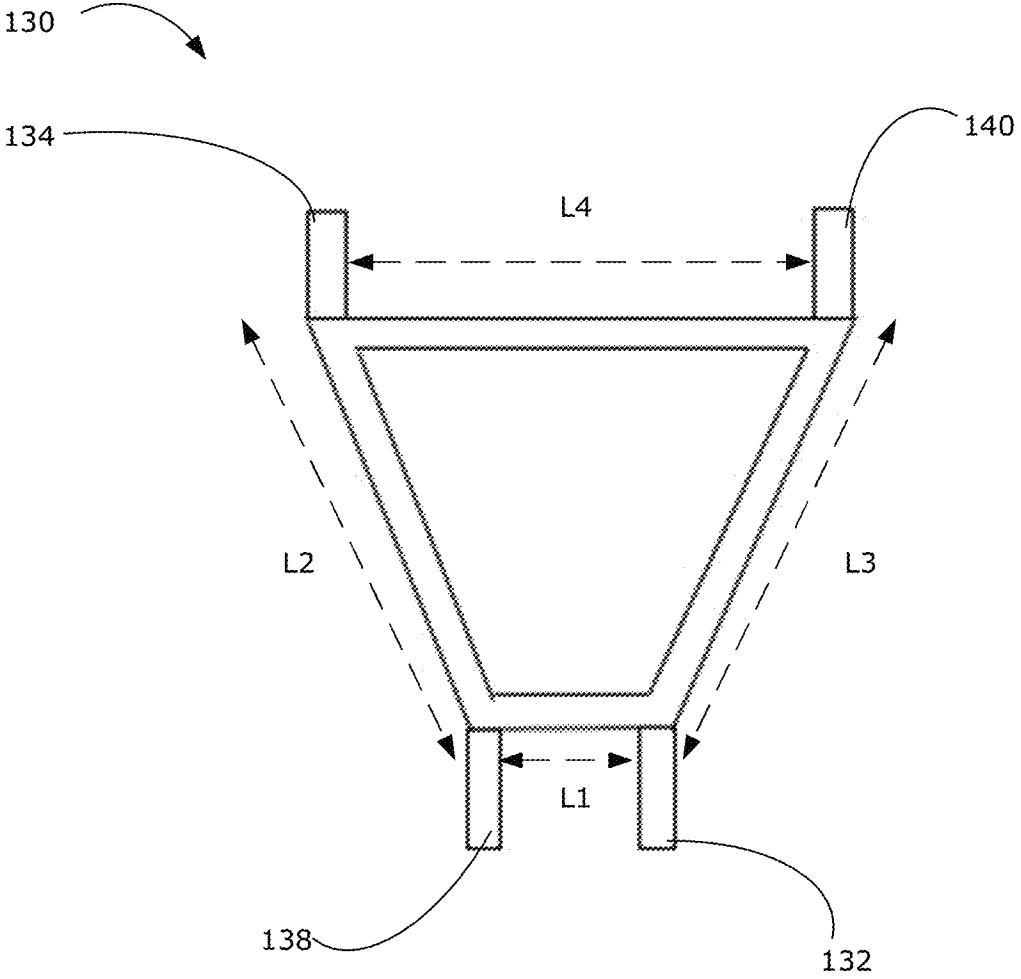
FIG. 6 is a simplified representation of the receive feed circuit for the example antenna of FIG. 1.

The configuration of the transmit and receive feed circuits 120, 130 may help to reduce or substantially eliminate self-interference, as explained with reference to FIGS. 5 and 6. FIG. 5 is a composite view of the transmit and receive feed circuits 120, 130, in which the difference path and sum path portions the receive feed circuit 130 (which may be provided on different sides of the substrate 110) of is shown together. FIG. 6 is a simplified representation of the receive feed circuit 130.

In the example shown, the receive feed circuit 130 includes a difference port 138 between the first and second receive ports 132, 134. The difference port 138 is located along the difference path portion of the receive feed circuit 130. The signal at the difference port 138 is a difference of the signals received at the first and second receive ports 132, 134. The receive feed circuit 130 also includes a sum port 140 between the first and second receive ports 132, 134. The sum port 140 is located along the sum path portion 136 of the receive feed circuit 130. The signal at the sum port 140 is a sum of the signals received at the first and second receive ports 132, 134. The sum port 140 may be located on the receive feed circuit 130 approximately opposite (but not necessarily strictly or directly opposite) to the difference port 138. Generally, the difference path portion and the sum path portion of the receive feed circuit 130 may be non-overlapping, and may together form a complete circuit.

The antenna 100 is a dual-polarity antenna, with the transmission signals and reception signals having orthogonal polarities. FIG. 5 illustrates the polarity of the transmission signals and reception signals at the antenna 100, with the polarity of the reception signals represented as thick arrows and the polarity of the transmission signals represented as thin arrows. Notably, the polarity of the reception signals is in-line with the electromagnetic field of the first aperture 112 (which may also be referred to as a receive slot) and the polarity of the transmission signals is orthogonal to the electromagnetic field of the first aperture 112. As will be understood, in the differential-mode receive feed circuit 130, the any transmission signal received at the first and second receive ports 132, 134 are at the same phase; however, the reception signal that is received, via the first aperture 112, at the first and second receive ports 132, 134 have a 180° phase offset between the first and second receive ports 132, 134. That is, the reception signal received at the first receive port 132 has a 180° phase difference when compared to the same reception signal received at the second receive port 134. For this reason, the first and second receive ports 132, 134 may also be referred to as 0° receive port and 180° receive port, respectively (or vice versa).

A signal received at the first receive port 132 travels a first electrical path length L1 to the difference port 138, and the same signal received at the second receive port 134 travels a second electrical path length L2 to the difference port 138. The difference between the first electrical path length L1 and the second electrical path length L2 is an odd integer multiple (i.e., 1, 3, 5, etc.) of half the signal wavelength λ. For example, the first electrical path length L1 may have a length of λ/4 and the second electrical path length L2 may have a length of 3λ/4, such that the difference between the first and second electrical path lengths L1, L2 is one half signal wavelength (i.e., λ/2). The difference path portion of the receive feed circuit 130 may be defined as the total of the first and second electrical path lengths L1, L2. As explained above, any transmission signal received at the first receive port 132 is at the same phase as the transmission signal received at the second receive port 134. Thus, the design of the first and second electrical path lengths L1, L2 causes the transmission signal received at the two receive ports 132, 134 to be cancelled out at the difference port 138. However, the reception signal is received with a 180° phase offset between the receive ports 132, 134 (i.e., the reception signal received at the first receive port 132 is 180° phase offset from the same reception signal received at the second receive port 134). The difference between the first and second electrical path lengths L1, L2 therefore causes the reception signal from the first and second receive ports 132, 134 to become aligned and the reception signal to be received at the difference port 138.

A signal received at the first receive port 132 travels a third electrical path length L3 to the sum port 140, and the same signal received at the second receive port 134 travels a fourth electrical path length L4 to the sum port 140. The third electrical path length L3 and the fourth electrical path length L4 are substantially equal in path length. The third and fourth electrical path lengths L3, L4 may be substantially equal to the first electrical path length L1 or the second electrical path length L2, or may be not equal to either the first or second electrical path lengths L1, L2. For example, the third and fourth electrical path lengths L3, L4 may each have a length of 3λ/4. The design of the third and fourth electrical path lengths L3, L4 provides a path for any undesired interference from transmission signals to be terminated at the sum port 140, without terminating any reception signal. The sum port 140 may be terminated in a load (not shown), such as a resistor.

In the present disclosure, it should be understood that an electrical path length is the circuit length, measured in terms of the signal wavelength λ, experienced by a signal. For example, given two circuits of equal physical length but different resistance, the circuit with higher resistance may be considered to have a longer electrical path length than the circuit with lower resistance. In some examples, the receive feed circuit 130 may be a printed circuit on the substrate 110, and may be printed with substantially same width throughout and using a single conductive material (e.g., copper). In such examples, the different electrical path lengths L1, L2, L3 and L4 may be achieved by using different physical lengths. In other examples, different electrical path lengths L1, L2, L3 and L4 may be achieved by using different materials in addition to or instead of different physical dimensions. Other suitable techniques may be used to achieve the desired electrical path lengths L1, L2, L3 and L4.

As a result of the configuration of the receive feed circuit 130, the signal received at the difference port 138 is substantially only the signal that is polarized in-line with the direction of the electromagnetic field of the first aperture 112, and any signal that has an orthogonal polarization to the field of the first aperture 112 is substantially eliminated from the difference port 138. The orthogonally polarized signal may be instead absorbed and terminated at the sum port 140. Thus, suppression of interference from the orthogonally polarized transmission signal may be achieved.

Figure 7:
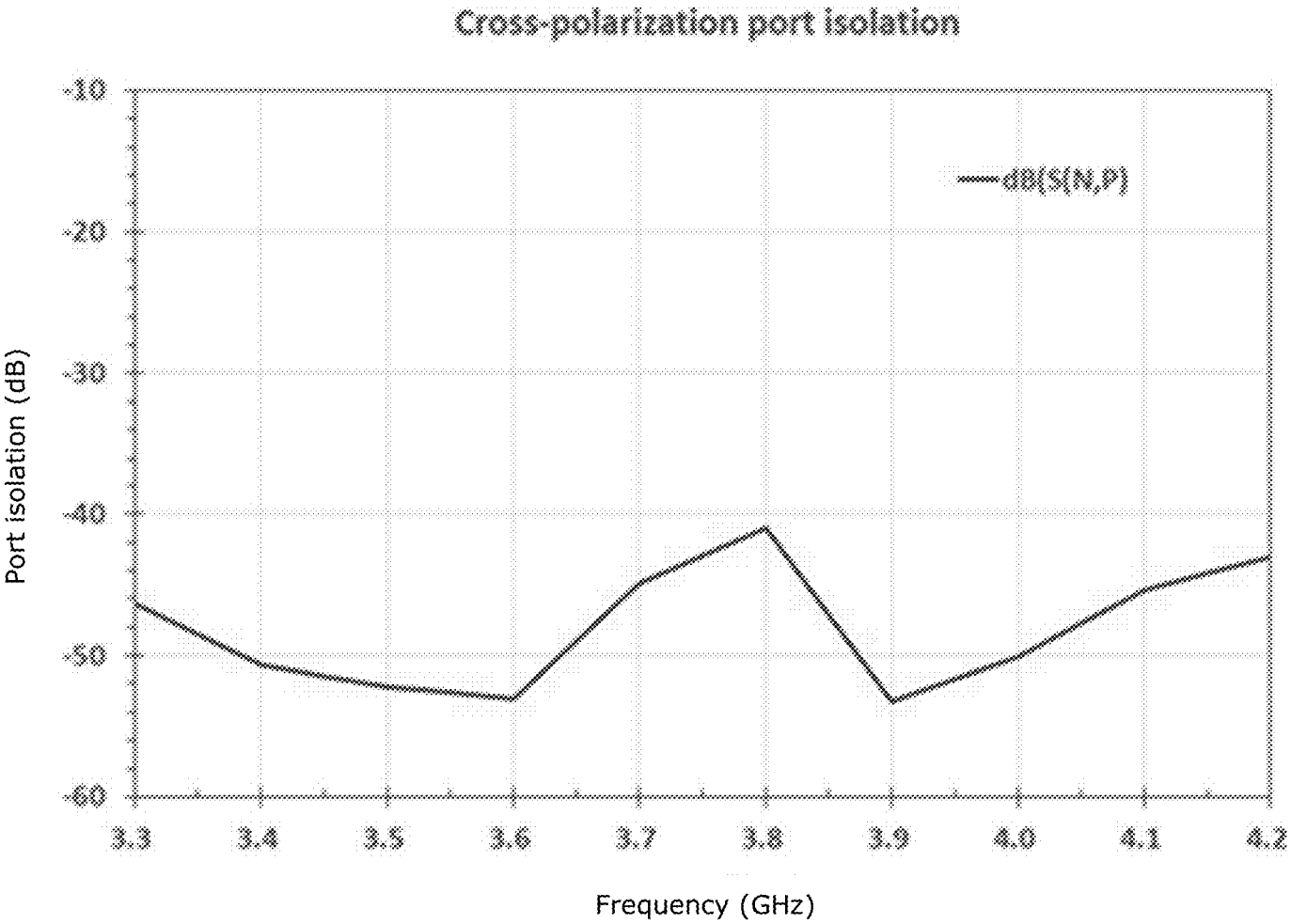
FIG. 7 is a graph illustrating example port isolation measurements for the example antenna of FIG. 1.
Figure 8:
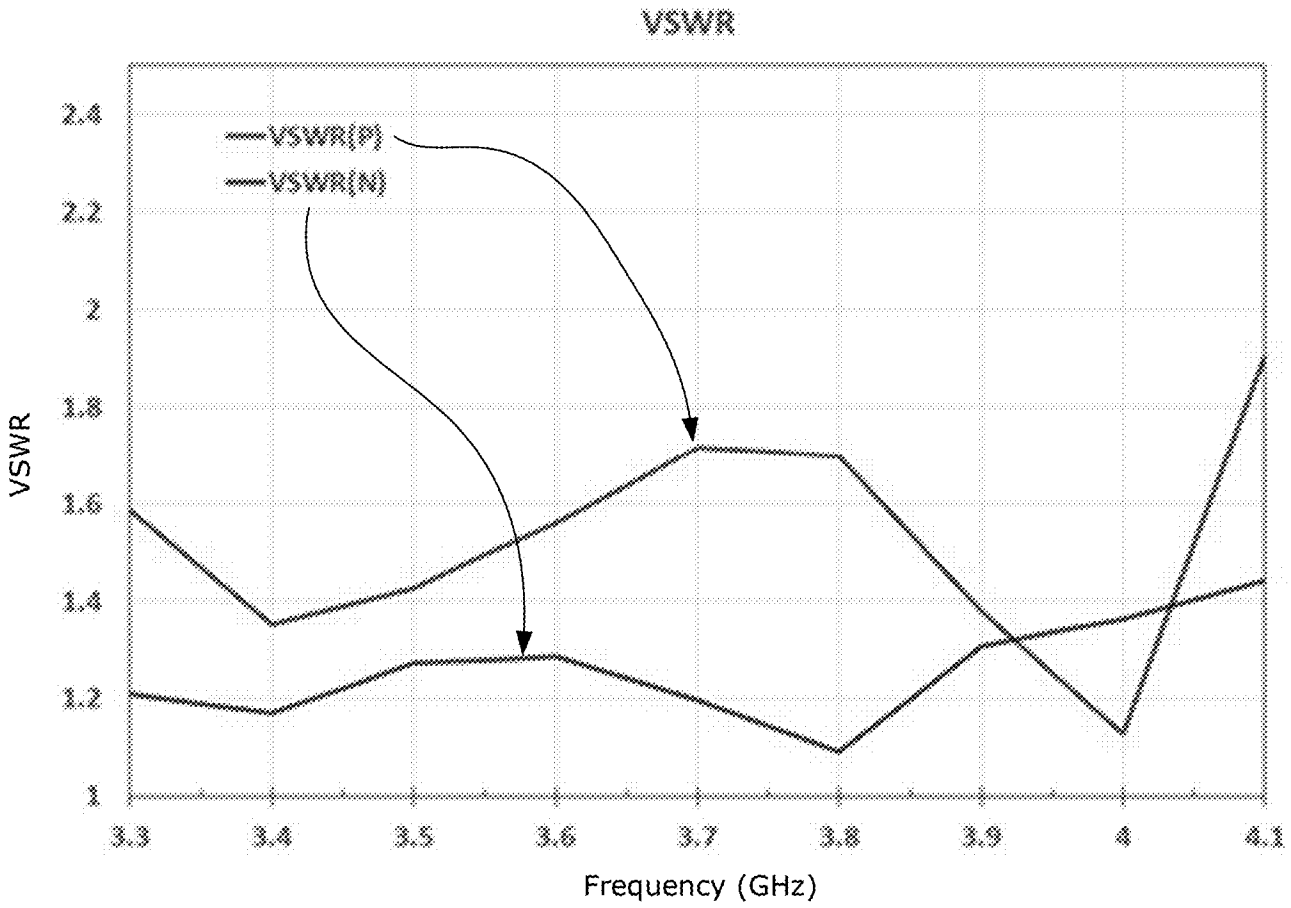
FIG. 8 is a graph illustrating example voltage standing wave ratio measurements for the example antenna of FIG. 1.

FIGS. 7 and 8 are graphs showing example full-wave simulated results that illustrate the performance of an example of the disclosed antenna. FIG. 7 shows example simulated port isolation measurements for the example antenna over a frequency range from about 3.3 GHz to about 4.2 GHz. As illustrated by this graph, examples of the disclosed antenna may be able to achieve port isolation in the range of about 40 dB to about 50 dB or more. This is an improvement over conventional dual-polarized aperture-coupled stacked patch antennas, and may be useful for full-duplex antenna arrays. FIG. 8 shows example simulated voltage standing wave ratio (VSWR) measurements, for the transmit port (indicated as "N") and difference port (indicated as "P") for the example antenna over a frequency range from about 3.3 GHz to about 4.1 GHz. As illustrated by this graph, examples of the disclosed antenna may be able to achieve VSWR in the range of about 1 to about 1.8.

Figure 9:
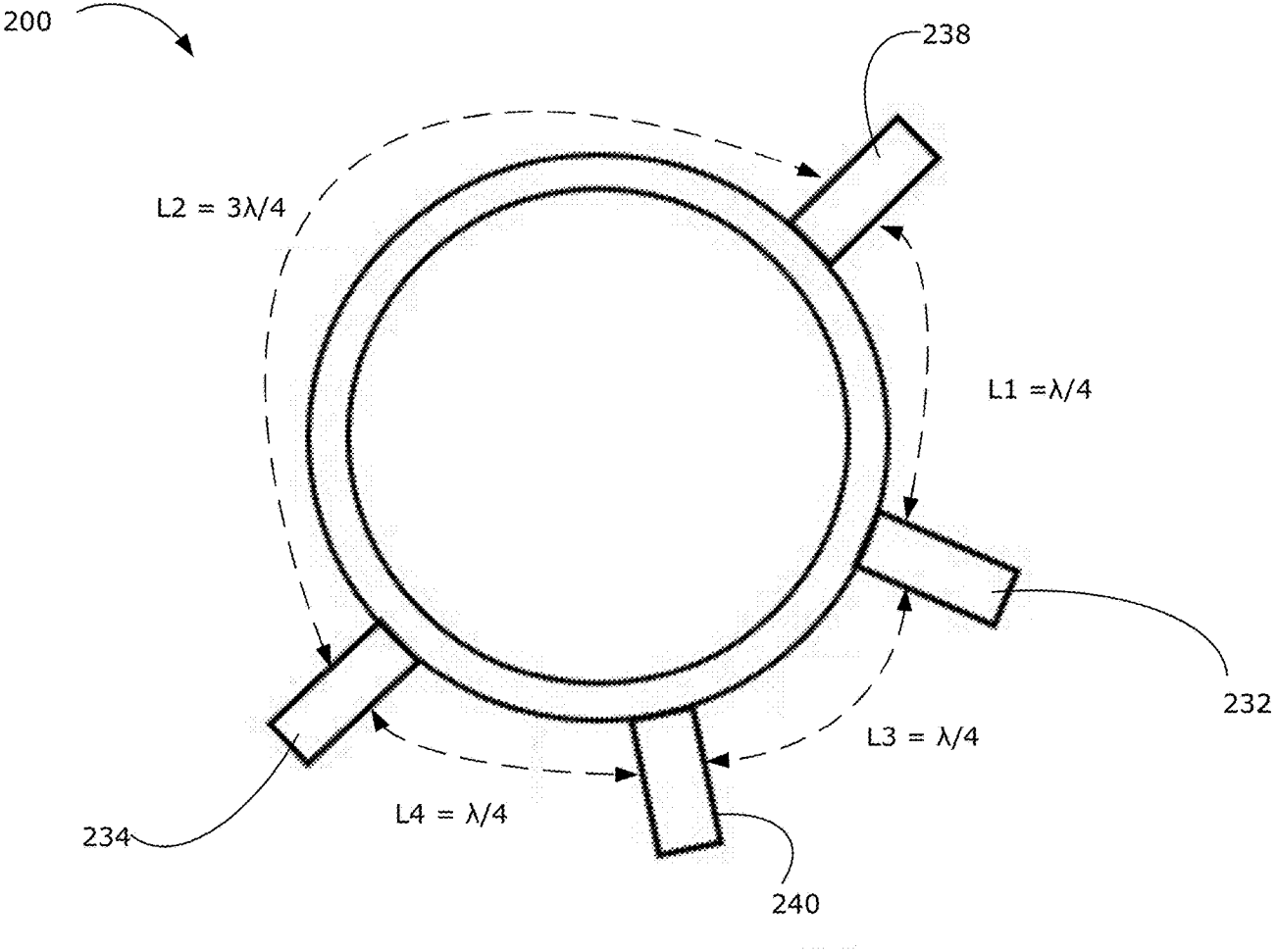
FIG. 9 is a schematic representation of an example 180° hybrid coupler that may be used for an example differential-mode feed circuit.

In some examples, the disclosed antenna may be realized using a 180° hybrid coupler. FIG. 9 is a schematic representation of an example 180° hybrid coupler 200 that may be used for implementing the receive feed circuit 130. The example hybrid coupler 200 provides a first receive port 232, a second receive port 234, a difference port 238 and a sum port 240. As shown in FIG. 9, a hybrid coupler 200 may be configured with electrical path lengths as indicated, to satisfy the requirements for L1, L2, L3 and L4 as discussed above. In other hybrid couplers, additional conductive lengths may be added to segments of the hybrid coupler, in order to satisfy the desired electrical path lengths for L1, L2, L3 and L4.

Figure 10:
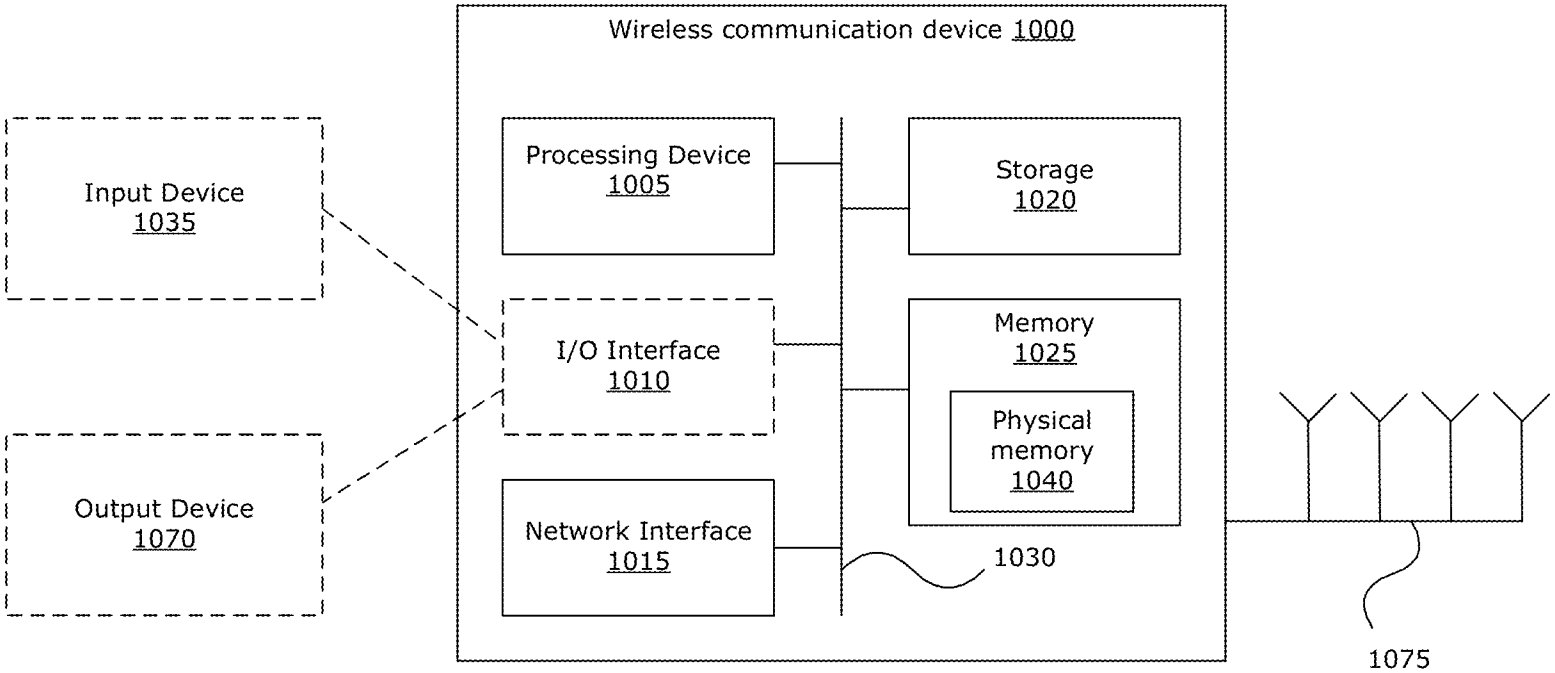
FIG. 10 is a schematic diagram of an example wireless communication device, in which an example of the disclosed antenna may be implemented.

Various examples of the disclose antenna may be implemented in different wireless communication devices, as mentioned above. FIG. 10 is a schematic diagram of an example wireless communication device 1000, in which examples of the antenna described herein may be used. Examples of the antennas described herein may be used as a single antenna, or as an antenna element in an antenna array of the wireless communication device 1000. For example, the wireless communication device 1000 may be a base station, an access point, or a client terminal in a wireless communication network. The wireless communication device 1000 may be used for communications within 5G communication networks or other wireless communication networks. Although FIG. 10 shows a single instance of each component, there may be multiple instances of each component in the wireless communication device 1000. The wireless communication device 1000 may be implemented using parallel and/or distributed architecture.

The wireless communication device 1000 may include one or more processing devices 1005, such as a processor, a microprocessor, an application-specific integrated circuit (ASIC), a field-programmable gate array (FPGA), a dedicated logic circuitry, or combinations thereof. The wireless communication device 1000 may also include one or more optional input/output (I/O) interfaces 1010, which may enable interfacing with one or more optional input devices 1035 and/or output devices 1070. The wireless communication device 1000 may include one or more network interfaces 1015 for wired or wireless communication with a network (e.g., an intranet, the Internet, a P2P network, a WAN and/or a LAN, and/or a Radio Access Network (RAN)) or other node. The network interface(s) 1015 may include one or more interfaces to wired networks and wireless networks. Wired networks may make use of wired links (e.g., Ethernet cable). The network interface(s) 1015 may provide wireless communication (e.g., full-duplex communications) via an antenna array 1075, as shown, in which examples of the antenna disclosed herein may serve as antenna elements. In other examples, the wireless communication device 1000 may use one instance of the disclosed antenna. The wireless communication device 1000 may also include one or more storage units 1020, which may include a mass storage unit such as a solid state drive, a hard disk drive, a magnetic disk drive and/or an optical disk drive.

The wireless communication device 1000 may include one or more memories 1025 that can include a physical memory 1040, which may include a volatile or non-volatile memory (e.g., a flash memory, a random access memory (RAM), and/or a read-only memory (ROM)). The non-transitory memory(ies) 1025 (as well as storage 1020) may store instructions for execution by the processing device(s) 1005. The memory(ies) 1025 may include other software instructions, such as for implementing an operating system (OS), and other applications/functions. In some examples, one or more data sets and/or modules may be provided by an external memory (e.g., an external drive in wired or wireless communication with the wireless communication device 1000) or may be provided by a transitory or non-transitory computer-readable medium. Examples of non-transitory computer readable media include a RAM, a ROM, an erasable programmable ROM (EPROM), an electrically erasable programmable ROM (EEPROM), a flash memory, a CD-ROM, or other portable memory storage.

There may be a bus 1030 providing communication among components of the wireless communication device 1000. The bus 1030 may be any suitable bus architecture including, for example, a memory bus, a peripheral bus or a video bus. Optional input device(s) 1035 (e.g., a keyboard, a mouse, a microphone, a touchscreen, and/or a keypad) and optional output device(s) 1070 (e.g., a display, a speaker and/or a printer) are shown as external to the wireless communication device 1000, and connected to optional I/O interface 1010. In other examples, one or more of the input device(s) 1035 and/or the output device(s) 1070 may be included as a component of the wireless communication device 1000.

The processing device(s) 1005 may also be used to control communicate transmission/reception signals to/from the antenna array 1075.

The use of a differential-mode receive feed circuit, for example as described above, may provide advantages over conventional aperture-coupled patch antennas that use single-ended feed circuits for both transmission and reception ports. Using a receive feed circuit with two receive ports, as in the disclosed antenna, rather than the conventional single receive port, may help to reduce or eliminate self-interference from transmission signals that are picked up at the receive port.

Some examples of the disclosed dual-polarized aperture-coupled stacked patch antenna may provide improved port isolation between two orthogonal polarizations. For example, isolation in the range of about 40 dB to about 50 dB may be achieved (which may be an improvement of about 10 dB to about 20 dB over a conventional dual-polarized aperture-coupled stacked patch antenna).

Examples of the disclosed antenna may be suitable for used in a full-duplex antenna array, including a closely-packed array configuration, for example for use in a base station or access point of a wireless communication network. Examples of the disclosed antenna may also be used in other wireless communication devices, including client devices such as a laptop device.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure. For examples, although certain sizes and shapes of the disclosed antenna have been shown, other sizes and shapes may be used.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. An aperture-coupled patch antenna comprising:

at least one radiating patch;

a substrate supporting the at least one radiating patch, the substrate including:

a first slot-shaped aperture for electromagnetic coupling of a reception signal from the at least one radiating patch to first and second receive ports; and a second slot-shaped aperture, orthogonal to the first aperture, for electromagnetic coupling of a transmission signal from a transmit port to the at least one radiating patch;

a transmit feed circuit provided on the substrate for communicating the transmission signal to the transmit port, the first feed circuit being a single-ended feed circuit; and a receive feed circuit provided on the substrate for communicating the reception signal from the receive ports, the receive feed circuit being a differential-mode feed circuit;

the receive feed circuit defining a difference port between the first and second receive ports, a first electrical path length travelled by a signal from the first receive port to the difference port and a second electrical path length travelled by a signal from the second receive port to the difference port differing by an odd integer multiple of half a signal wavelength; and the receive feed circuit defining a sum port between the first and second receive ports, a third electrical path length travelled by a signal from the first receive port to the sum port and a fourth electrical path length travelled by a signal from the second receive port to the sum port being equal in path length.

2. The antenna of claim 1, wherein the receive feed circuit comprises a difference path portion provided on a first side of the substrate and a sum path portion provided on an opposing second side of the substrate, wherein the difference path portion includes the first and second electrical path lengths, and the sum path portion includes the third and fourth electrical path lengths.

3. The antenna of claim 2, wherein the substrate is a double-sided printed circuit board (PCB), and the difference path portion and the sum path portion are printed on respective sides of the PCB.

4. The antenna of claim 2, wherein the substrate comprises a first printed circuit board (PCB) on which the difference path portion is provided, and a second PCB on which the sum path portion is provided.

5. The antenna of claim 1, wherein the first and second receive ports are located at opposite ends of the second aperture, to cause the first receive port to receive a signal that is 180° offset from that received by the second receive port.

6. The antenna of claim 1, wherein the first electrical path has a path length of ¾ of the signal wavelength, and the second electrical path has a path length of ¼ of the signal wavelength.

7. The antenna of claim 1, wherein the third and fourth electrical paths each has a path length of ¾ of the signal wavelength.

8. The antenna of claim 1, wherein the substrate includes a ground plane of the antenna.

9. The antenna of claim 1, wherein the first aperture and the second aperture have different slot widths.

10. The antenna of claim 1, wherein the first aperture and the second aperture cross each other at respective midpoints.

11. The antenna of claim 1, wherein the receive feed circuit includes a 180° hybrid coupler.

12. The antenna of claim 1, comprising two radiating patches, and wherein:

the first aperture electromagnetically couples the reception signal from the two radiating patches to the receive ports; and the second aperture electromagnetically couples the transmission signal from the transmit port to the two radiating patches.

13. A wireless communication device comprising:

a wireless communication interface for processing transmission and reception signals; and an aperture-coupled patch antenna for communicating the transmission and reception signals, the antenna comprising:

at least one radiating patch;

a substrate supporting the first and second radiating patches, the substrate including:

a first slot-shaped aperture for electromagnetic coupling of the reception signal from the at least one radiating patch to first and second receive ports; and a second slot-shaped aperture, orthogonal to the first aperture, for electromagnetic coupling of the transmission signal from a transmit port to the at least one radiating patch;

a transmit feed circuit provided on the substrate for communicating the transmission signal to the transmit port, the first feed circuit being a single-ended feed circuit; and a receive feed circuit provided on the substrate for communicating the reception signal from the receive ports, the receive feed circuit being a differential-mode feed circuit;

the receive feed circuit defining a difference port between the first and second receive ports, a first electrical path length travelled by a signal from the first receive port to the difference port and a second electrical path length travelled by a signal from the second receive port to the difference port differing by an odd integer multiple of half a signal wavelength; and the receive feed circuit defining a sum port between the first and second receive ports, a third electrical path length travelled by a signal from the first receive port to the sum port and a fourth electrical path length travelled by a signal from the second receive port to the sum port being equal in path length.

14. The device of claim 13, wherein, in the antenna, the first and second receive ports are located at opposite ends of the second aperture, to cause the first receive port to receive a signal that is 180° offset from that received by the second receive port.

15. The device of claim 13, wherein, in the antenna, the first electrical path has a path length of ¾ of the signal wavelength, and the second electrical path has a path length of ¼ of the signal wavelength.

16. The device of claim 13, wherein, in the antenna, the third and fourth electrical paths each has a path length of ¾ of the signal wavelength.

17. The device of claim 13, wherein the wireless communication interface is configured for full-duplex wireless communications.

18. The device of claim 13, wherein the antenna includes two radiating patches, and wherein:

the first aperture electromagnetically couples the reception signal from the two radiating patches to the receive ports; and the second aperture electromagnetically couples the transmission signal from the transmit port to the two radiating patches.

* * * * *